US006135740A

United States Patent [19]

Hult et al.

[11] Patent Number: 6,135,740

[45] Date of Patent: Oct. 24, 2000

[54] PUMP DRIVE HEAD BACKSPIN RETARDER

[75] Inventors: Vern Arthur Hult; Edward Leigh Schubert, both of Calgary, Canada

[73] Assignee: Weatherford Holding U.S., Inc., Houston, Tex.

[21] Appl. No.: 08/948,810

[22] Filed: Oct. 9, 1997

[30] Foreign Application Priority Data

Oct. 10, 1996 [CA] Canada ..... 2187579

[51] Int. Cl.[7] ..... F01C 21/00; F04C 29/00

[52] U.S. Cl. ..... 418/69; 166/68

[58] Field of Search ..... 418/69; 166/68

[56] References Cited

U.S. PATENT DOCUMENTS

| | | | |
|---|---|---|---|
| 127,009 | 3/1872 | Feite | 137/115.2 |
| 3,463,279 | 8/1969 | Breisch et al. | 192/35 |
| 3,511,348 | 5/1970 | Jonsson et al. | 192/43.1 |
| 5,503,541 | 4/1996 | Barito et al. | 418/69 |
| 5,551,510 | 9/1996 | Mills | 166/68 |

FOREIGN PATENT DOCUMENTS 1160476 1/1984 Canada .

2011516 3/1990 Canada .

OTHER PUBLICATIONS

Design Engineers Handbook, Bulletin 0224–B1, pp. i–12 to i–13, 1979.

*Primary Examiner*—Charles G. Freay
*Assistant Examiner*—Cheryl J. Tyler
*Attorney, Agent, or Firm*—Hayes, Soloway, Hennessey, Grossman & Hage, P.C.

[57] ABSTRACT

A pump drive head backspin retarder includes a vane pump having an impeller with a plurality of spring loaded vanes and a pawl clutch centrally disposed in the impeller and having a hub and a plurality of pawls. Each pawl is pivotally attached to the hub for movement between first and second positions. The impeller includes a plurality of pawl receiving recesses, whereby, for a first direction of rotation, pawls of the pawl clutch pivot to the first position corresponding to a disengaged state for providing no mechanical contact with the impeller and, for a second direction of rotation opposite the first, pawls of the pawl clutch pivot to the second position due to inertia corresponding to an engaged state thereby engaging corresponding pawl receiving recesses.

15 Claims, 4 Drawing Sheets

PUMP DRIVE HEAD BACKSPIN RETARDER

FIELD OF THE INVENTION

The present invention relates to pump drive head backspin retarders and is particularly concerned with clutches for vane pumps.

BACKGROUND OF THE INVENTION

It is well known to use screw pumps in deep well applications such as pumping oil from wells. There are a number of challenges presented by the use of screw pumps with which existing well head drives are intended to deal. It is necessary to control the backspin that occurs on shutting down a well. Backspin is caused by two energy storage systems, inherent in deep well screw pump operation. The first energy storage system results from a fluid head in the well that on shutting off the pump drive effectively turns the screw pump into a motor. The second energy storage system results from torsion of the sucker rods linking the drive head to the screw pump. Current drive heads provide a mechanism for mitigating the backspin caused by these stored energy systems. However, present solutions may be less effective and require higher maintenance than desirable.

Reliability of backspin retarders has become a problem primarily due to increased fluid head and larger pumps than were prevalent a few years ago. Higher torque utilized by larger pumps means more energy is stored as wind-up of the sucker rod strength. Greater fluid head means more energy is stored above the pump in the fluid column which drains back through the pump causing the sucker rods to rotate backwards on shutdown. Energy stored by rod windup and fluid head must be absorbed by the backspin retarders without overheating the backspin brake. The combination of higher torque and fluid energy has put more demands on backspin retarders than earlier versions were capable of withstanding.

SUMMARY OF THE INVENTION

An object of the present invention is to provide an improved backspin retarder.

In accordance with an aspect of the present invention there is provided a pump drive head backspin retarder comprising a vane pump having an impeller with a plurality of spring loaded vanes; and a pawl clutch centrally disposed in the impeller and having a hub and a plurality of pawls, each pawl pivotally attached to the hub for movement between first and second positions; the impeller including a plurality of pawl receiving recesses; whereby, for a first direction of rotation, pawls of the pawl clutch pivot to the first position corresponding to a disengaged state for providing no mechanical contact with the impeller and, for a second direction of rotation opposite the first, pawls of the pawl clutch pivot to the second position due to inertia, corresponding to an engaged state thereby engaging corresponding pawl receiving recesses.

In accordance with another aspect of the present invention there is provided a pump drive head comprising a housing; a main shaft rotatably coupled to the housing for connection to a pump driving rod; and a backspin retarder including a pawl clutch connected to the main shaft and a hydraulic pump, the pawl clutch having engaged and disengaged states corresponding to first and second directions of operation, in the first direction, the pawl clutch is in the disengaged state and the hydraulic pump is idle thereby providing a relatively low resistance to rotation of the main shaft, in the second direction of rotation, the pawl clutch is in the engaged state causing the hydraulic pump to pump fluid thereby providing a relatively high resistance to rotation of the main shaft, the pawl clutch includes a plurality of pawls and the hydraulic pump includes an impeller having a corresponding plurality of pawl engaging recesses.

There are numerous advantages of the present invention and embodiments thereof. The pawl clutch allows forward rotation and positively engages on reverse rotation. In the forward rotation direction very little resistance is introduced by the pawl clutch.

Pawls do not contact any part, rotating relative to them, consequently are not subject to mechanical wear when the pawl clutch is disengaged or freewheeling in the forward direction of rotation of the main shaft. As pawls are engaged due to inertia, they do not rely on springs or other mechanical parts subject to failure. Engagement of pawls is further assisted by viscous drag of the oil in which they are immersed. Due to symmetry of each pawl about its pivot pin, centrifugal force does not tend to engage the pawls in the forward direction.

BRIEF DESCRIPTION OF DRAWINGS

The present invention will be further understood from the following description with references to the drawings in which.

DETAILED DESCRIPTION

Figure 1:
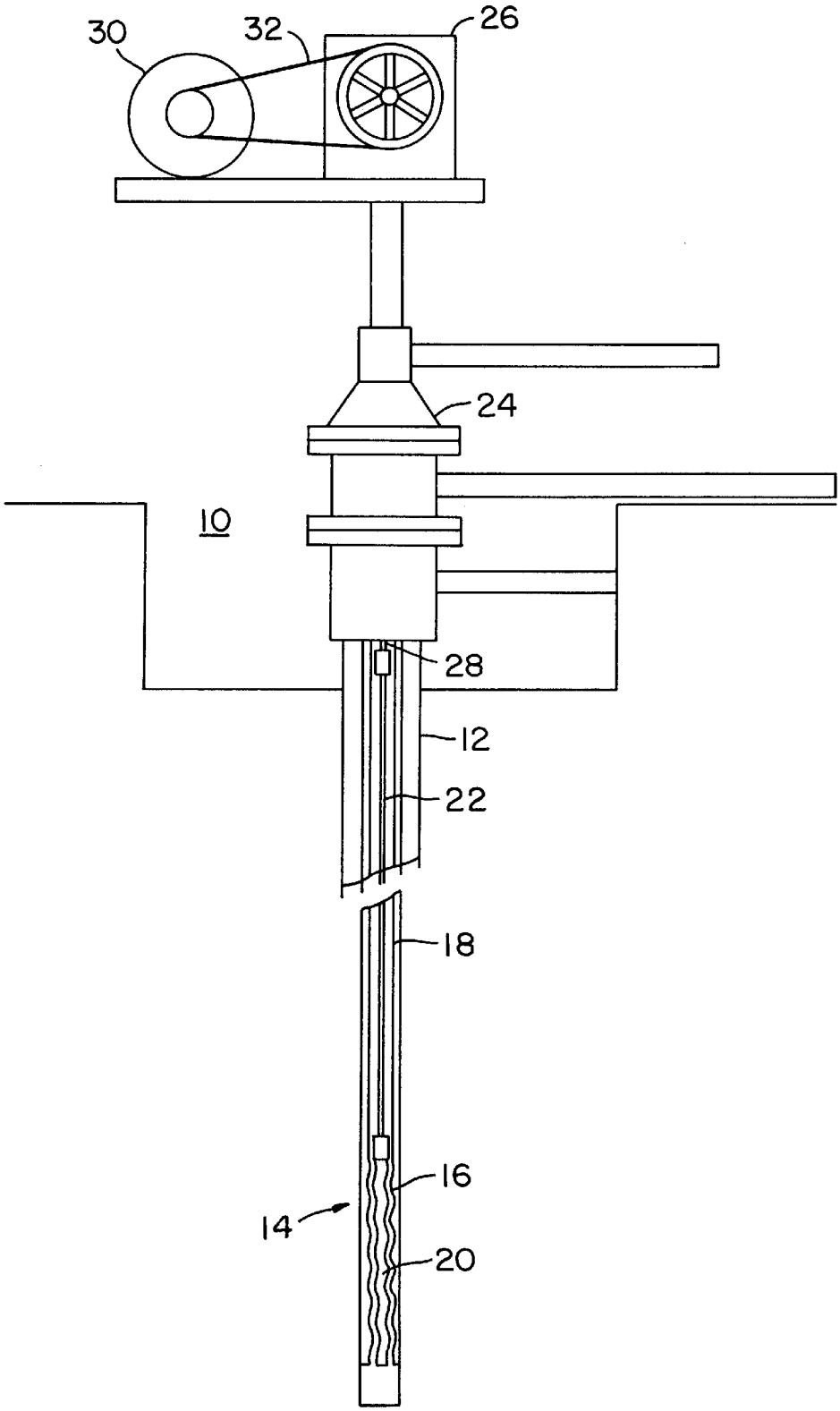
FIG. 1 PRIOR ART
FIG. 1 illustrates a known well pump installation.

Referring to FIG. 1, there is illustrated a known well pump installation. As is typical such installations include a well 10 having a casing 12, a screw pump 14 having a stator 16 coupled to a production tubing 18 and a rotor 20 coupled to a plurality of sucker rods 22. The production tubing and sucker rods extend the full height of the well 10 to the surface where the production tubing is terminated by a tubing head adapter 24. Mounted on top of the well pump installation is a drive head 26. The sucker rods 22 are coupled to a polished rod 28 below the tubing head adapter 24. The polished rod 28 extends up through the drive head 26, not shown in FIG. 1. The drive head is coupled to an electric motor 30, typically via a drive belt 32.

In operation, the electric motor 30 powers the drive head 26 that turns the pump rotor 20 via the polished rod 28 and the plurality of sucker rods 22.

Figure 2:
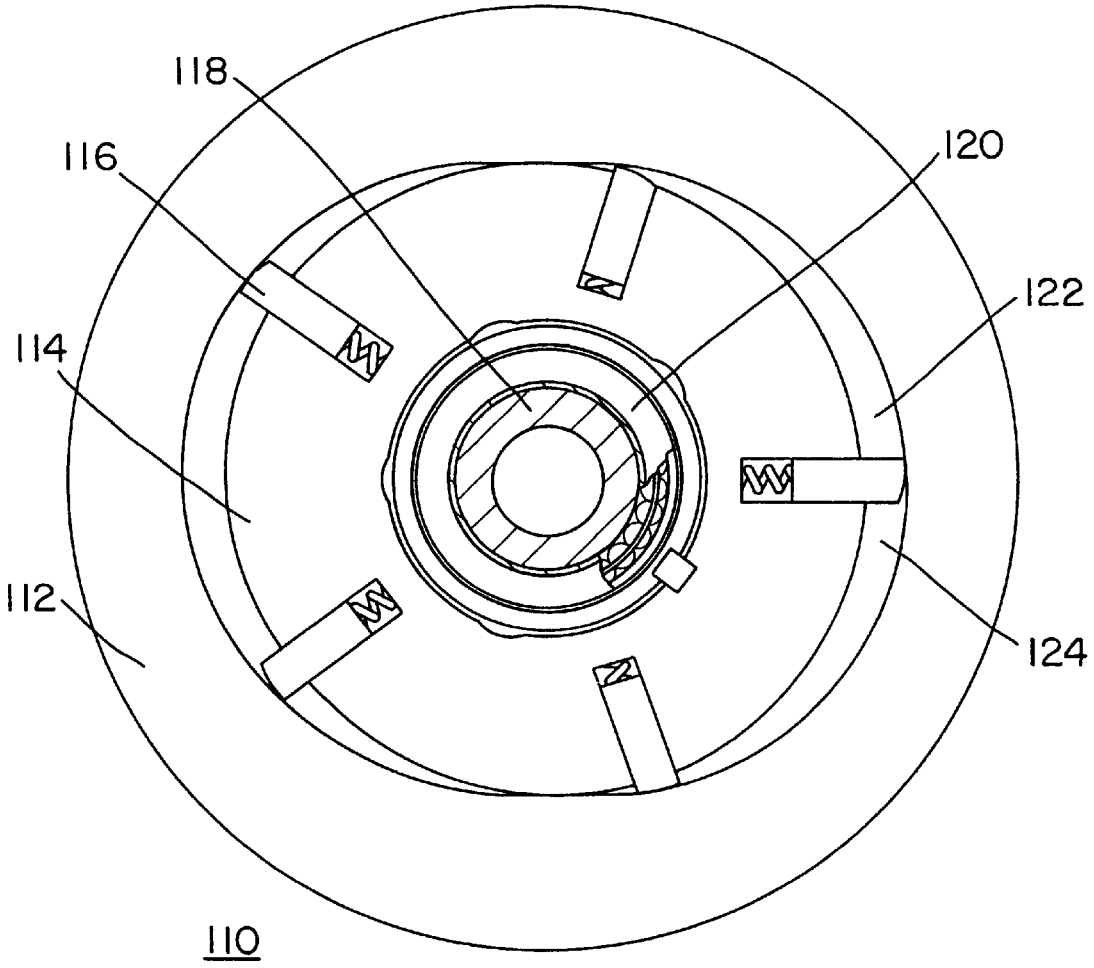
FIG. 2 PRIOR ART
FIG. 2 illustrates, in a plan view horizontal cross-section, with partial cut-away, a known backspin retarder.

Referring to FIG. 2 there is illustrated, in a plan view horizontal cross-section, with partial cut-away, a known backspin retarder.

The vane backspin retarder 110 includes an impeller housing 112 and an impeller 114 received therein. The impeller 114 includes a plurality of spring loaded vanes 116 and is mounted on a shaft 118 via a cam clutch 120.

In operation, the first direction of rotation of shaft 118 is permitted by the cam clutch 120. This first direction corresponds to a normal pump operation direction. When the pump drive motor is shut off, torque stored in the lengths of sucker rods between the drive head, at the wellhead, and the rotary pump deep within the well, together with the oil column within the well, cause shaft 118 to rotate in a second direction opposite the first direction. Left unchecked the drive head and attached motor would be driven to dangerously high speeds. This problem is well known, hence, an existing solution is illustrated in FIG. 2. That is, the provision of the vane backspin retarder 110. When the shaft 118 begins to rotate in the second direction the cam clutch 120 engages thereby coupling the shaft 118 to the impeller 114. The rotation of the impeller 114 causes the formation of a pressure zone 122 and a suction zone 124 in the hydraulic fluid in the backspin retarder as is well known in the art. However, such cam clutches are prone to failures. Two causes of failures have been identified:

(1) wear on the cam clutch and shaft, which changes the geometry of the device, such that friction can no longer cause self-locking action. Use of lubricants containing EP additives, especially grease, is a contributing factor to earlier slipping as they reduce friction;

(2) overloading the cam clutch causing the sprags (sometimes called cams) to roll over. Sprag rollovers damage the actuating spring and cause the cam clutch to slip. Also sprags do not return to the correct position and can interfere with engagement of other sprags. During testing it has been observed that cam clutches are particularly vulnerable to sprag rollover failures during cold start-ups even when applied torque is within the manufacturer's rating. Differences in thermal expansion between the housing impeller and shaft could also be factors in cam rollovers.

Wear of cam clutches is caused when the drive unit rotates in the forward direction. Cam clutches have spring loaded sprags that drag on the shaft as the shaft turns. The sliding action causes wear on the sprag and shaft that changes the precise geometry of the device and allows it to slip. Since screw drive pumps accumulate up to 8700 hours per year and frequent replacement of worn parts is considered prohibitively expensive by users, screw pumps are unlike other applications where overrunning clutches are typically used. Torque overloads, which cause sprag rollovers and spring damage, could cause the cam clutch to slip during a high torque shutdown even on a new installation and especially during cold starts.

Figure 3:
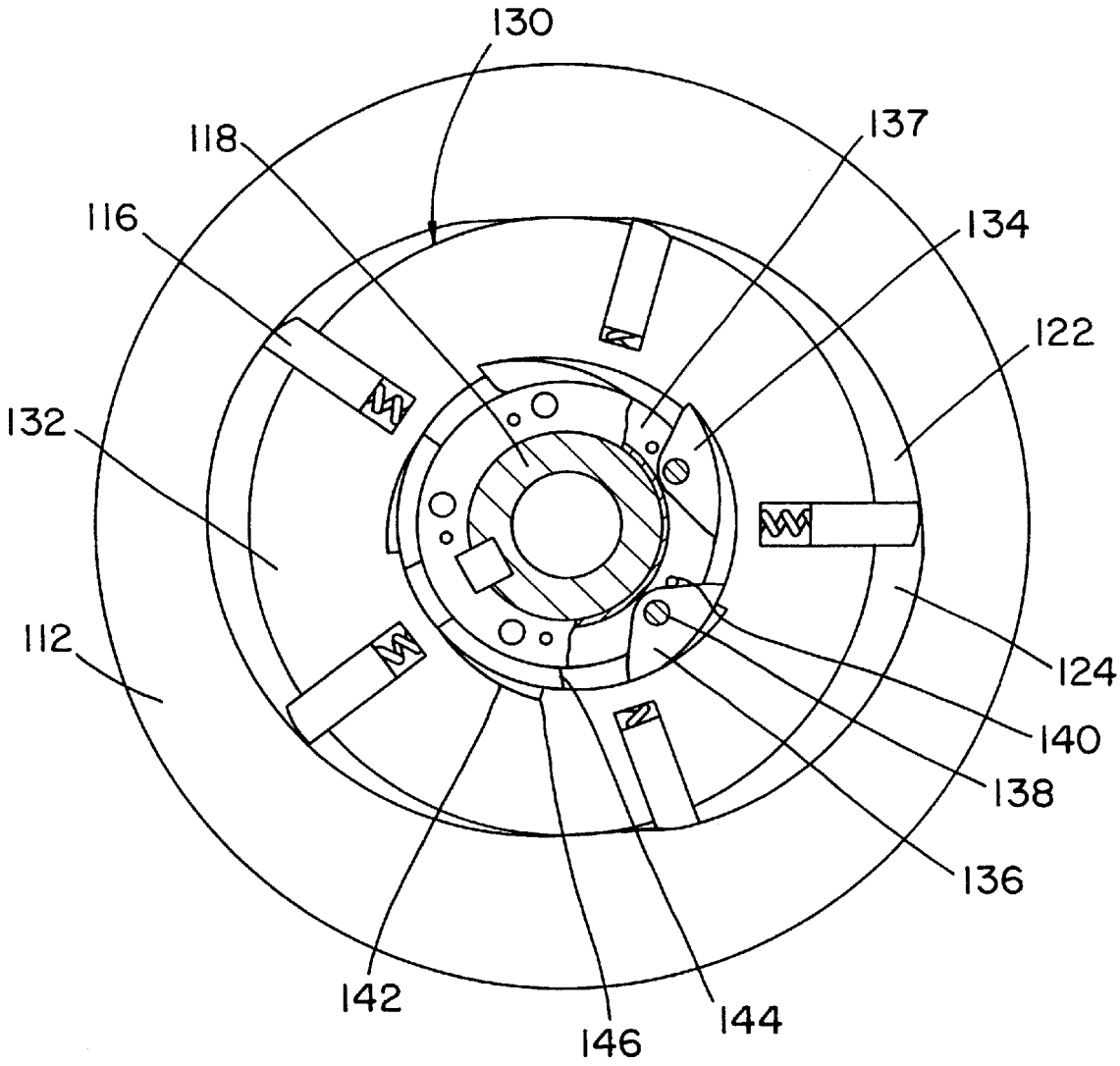
FIG. 3 illustrates, in a plan view horizontal cross-section, with partial cut-away, a backspin retarder in accordance with an embodiment of the present invention.

Referring to FIG. 3, there is illustrated in a plan view, horizontal cross-section with partial cutaway, a backspin retarder in accordance with an embodiment of the present invention. The vane backspin retarder 130 includes an impeller housing 112 and an impeller 132 received therein. The impeller 132 includes a plurality of spring-loaded vanes 116 and is mounted on the shaft 118 via a pawl clutch 134. The pawl clutch 134 includes a plurality of pawls 136 each pivotally connected to a hub 137 by a pawl pivot pin 138. A pivot stop pin 140 limits travel of the pawl 136 in a first position corresponding to a disengaged position. The impeller 132 is provided with a corresponding plurality of pawl receiving recesses 142. Each pawl 136 has a flat 144 and each recess 142 has a corresponding shoulder 146.

To illustrate both engaged and disengaged positions in a single figure in FIG. 3, two pawls are drawn in the engaged position and three are shown in the disengaged position. In an actual pawl clutch, all pawls are designed to engage substantially simultaneously.

In operation, when the shaft 118 turns in the first direction, that is the normal pumping direction, fluid pressure around the pawl clutch 134 forces pawls 136 to the first positions. Thus, for normal operation pawls 136 are in a non-engaging configuration. On shut-down when backspin begins, the same fluid pressure causes pawls 136 to move towards the second position. Constrained only by the impeller 132, pawls 136 continue to extend outward into corresponding recesses 142 until they reach the second position, at which time flats 144 of pawls 136 engage shoulders 146 of recesses 142 to effect full engagement of the pawl clutch 134 and impeller 132. Appropriate sizing of pawl pivot pin 138, flat 144 and shoulder 146 ensures reliable operation of the pawl clutch.

Figure 4:
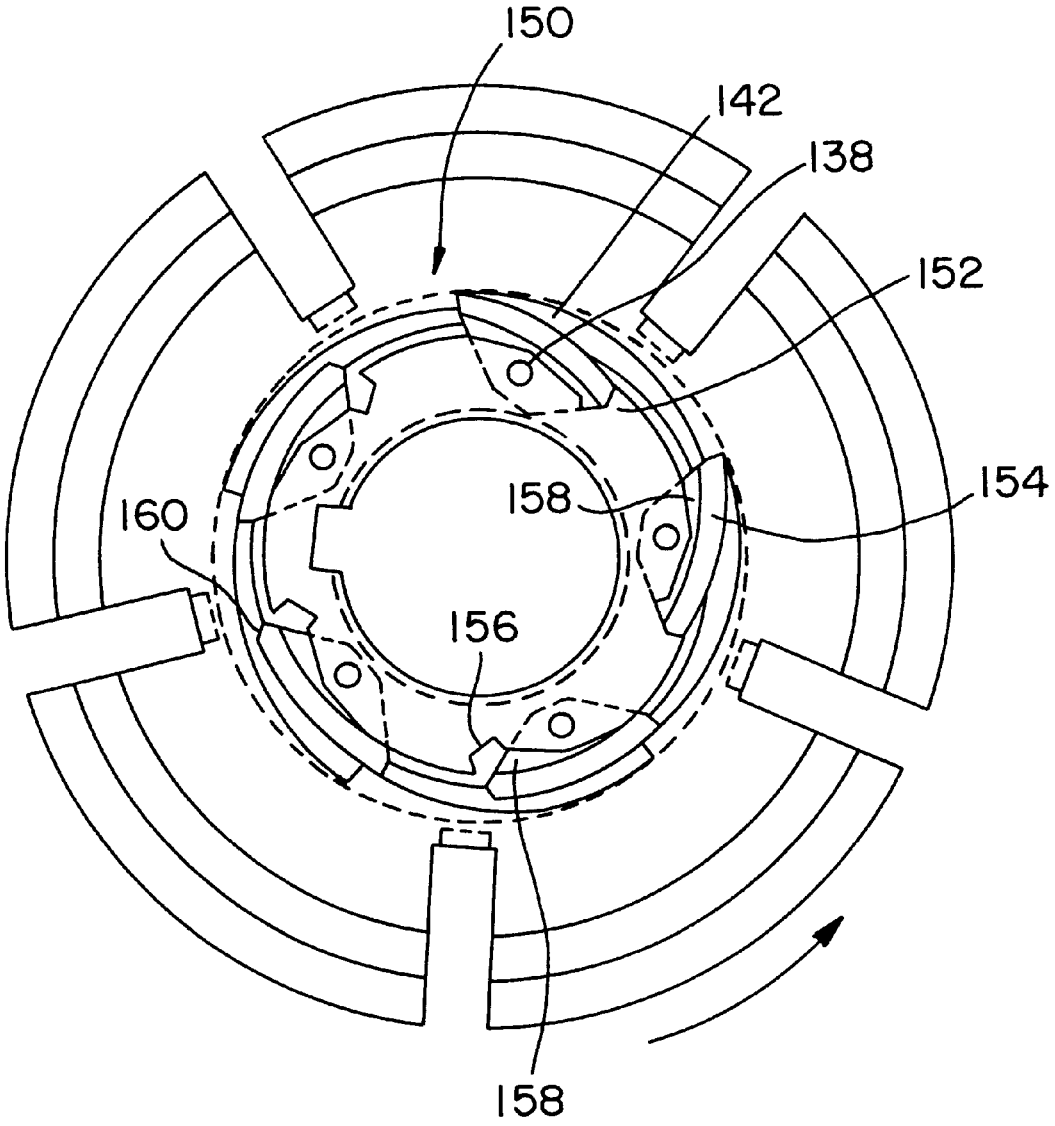
FIG. 4 illustrates, in a plan view, a pawl clutch and an impeller for a backspin retarder in accordance with another embodiment of the present invention.

Referring to FIG. 4, there is illustrated, in a plan view, a pawl clutch and an impeller for a backspin retarder in accordance with another embodiment of the present invention. The pawl clutch 150 includes a hub 152 and a plurality of pawls 154 pivotally attached thereto. The hub 152 includes a plurality of notches 156 corresponding to the plurality of pawls 154. Each pawl has a relieved face 158 to facilitate attachment to hub 152 and an end profile 160 corresponding to the notches 156.

As noted herein above in connection with FIG. 3, FIG. 4 uses the same scheme to illustrate both engaged and disengaged positions of the pawls in a single figure.

In operation, when pawls 154 engage impeller recesses 142, end profiles 160 simultaneously engage notches 156. Pawl pivot pins 138 are thereby relieved of a substantial portion of the applied load enhancing their reliability.

Numerous modifications, variations and adaptations may be made to the particular embodiments of the invention described above without departing from the scope of the invention as defined in the claims.

What is claimed is:

1. A backspin retarder for use in a drive head for driving an oil-well downhole pump, said drive head having a drive shaft and fluid pump for resisting reverse rotation of said drive shaft, said backspin retarder comprising:

an impeller for said fluid pump, said impeller being concentrically mounted with respect to said shaft for rotation about the axis of said shaft and having an inner surface and a plurality of shoulders in said inner surface;

a hub for connection to said drive shaft for rotation therewith; and a plurality of pawls mounted on said hub for pivotal movement about a respective pivot axis at a right angle to a line extending through the axis of said drive shaft and the center of said pawl between impeller engaged and disengaged positions under the influence of inertia in response to a change in the rotational speed of said drive shaft, each of said pawls having a pawl body with a center of mass disposed radially outwardly of said respective pivot axis from said shaft axis, said pawls in said disengaged position being in a non-contact disposition with respect to said impeller and said pivot axis, said axis of rotation, and the center of mass being substantially colinear such that said drive shaft and said impeller are free to rotate independently of one another and, in said engaged position, said pawls engaging said shoulders for transferring torque form said shaft and said impeller to drive said fluid pump.

2. A backspin retarder as defined in claim 1, each said pawl further having an arcuate outer surface arranged such that, in said disengaged position, said arcuate surface is centered on the axis of said drive shaft and spaced inwardly of said impeller inner surface in non-contact relation thereto, and, in said engaged position, the center of said arcuate surface is displaced from the shaft axis so that a portion of the pawl intersects and engages said inner surface.

3. A backspin retarder as defined in claim 2, each said pawl further having a shoulder for engaging a mating shoulder in the inner surface of said impeller, said pawl shoulder being located at the trailing end of said arcuate surface with respect to the forward direction of rotation of said shaft and extends in a longitudinal plane which intersects the inner surface of the impeller.

4. A backspin retarder as defined in claim 3, said plurality of pawls being equally angularly spaced about the axis of the shaft.

5. A backspin retarder as defined in claim 1, said impeller being formed with a plurality of equally angularly spaced recesses in said inner surface for receiving one of said pawls, the number of said plurality of recesses corresponding to the number of said plurality of pawls, and a pawl engaging shoulder located at the trailing end of each of said plurality of recesses with respect to the normal direction of rotation of said drive shaft so that when said drive shaft changes direction, said pawl shoulder and impeller shoulder move toward and engage one another.

6. A backspin retarder as defined in claim 1, each said pawl having a shoulder at each end of said body, one of said shoulder being engageable with a mating shoulder in said impeller and the other of shoulders being engageable with a mating shoulder in said hub in said disengaged position of said pawls so that torque transfer between said hub and said impeller is substantially through said pawl body.

7. A backspin retarder as defined in claim 6, each said pawl further having a shoulder for engaging a mating shoulder in the inner surface of said impeller, said pawl shoulder being located at the trailing end of said arcuate surface with respect to the forward direction of rotation of said shaft and extends in a longitudinal plane which intersects the inner surface of the impeller.

8. A backspin retarder as defined in claim 7, said plurality of pawls being equally angularly spaced about the axis of the shaft.

9. A drive head for use in driving an oil-well downhole pump, comprising:

a housing, a fluid pump chamber in said housing;

a drive shaft mounted in said housing for rotation therein and for rotatably driving said downhole pump;

a fluid pump impeller in said pump chamber and rotatable about the axis of said drive shaft, said impeller having:

an inner cylindrical surface, a plurality a shoulders in said inner surface, a plurality of outwardly biased vanes engageable with said fluid pump chamber for pumping fluid into and out of said fluid pump in response to rotation of said impeller; and a backspin retarder having:

a hub for connection to said drive shaft for rotation therewith; and a plurality of pawls mounted on said hub for pivotal movement about a respective pivot axis at a right angle to a line extending through the axis of said drive shaft and the center of said pawl under the influence of inertia in response to a change in the speed of rotation of said drive shaft, each of said pawls having a center of mass disposed radially outwardly of said respective pivot axis from said shaft axis and said pawls and being moveable between a disengaged position in which said pawls are in a non-contact disposition with respect to said impeller and said pivot axis, said axis of rotation, and the center of mass being substantially colinear such that said drive shaft and said impeller are free to rotate independently of one another and, an impeller engaged position in which said pawls engage said shoulders on said impeller for transferring torque from said shaft and said impeller to drive said fluid pump.

10. A drive head as defined in claim 9, each said pawl further having an arcuate outer surface arranged such that, in said disengaged position, said arcuate surface is centered on the axis of said drive shaft and spaced inwardly of said impeller inner surface in non-contact relation thereto, and, in said engaged position, the center of said arcuate surface is displaced from the shaft axis so that a portion of the pawl intersects and engages said inner surface.

11. A drive head as defined in claim 10, each said pawl further having a shoulder for engaging a mating shoulder in the inner surface of said impeller, said pawl shoulder being located at the trailing end of said arcuate surface with respect to the forward direction of rotation of said shaft and extends in a longitudinal plane which intersects the inner surface of the impeller.

12. A drive head as defined in claim 9, said plurality of pawls being equally angularly spaced about the axis of the shaft.

13. A drive head as defined in claim 9, said impeller is formed with a plurality of equally angularly spaced recesses in said inner surface for receiving one of said pawls, the number of said plurality of recesses corresponding to the number of said plurality of pawls, and a pawl engaging shoulder located at the trailing end of each of said plurality of recesses with respect to the normal direction of rotation of said drive shaft so that when said drive shaft changes direction, said pawl shoulder and impeller shoulder move toward and engage one another.

14. A drive head as defined in claim 10, each said pawl having a shoulder at each end of said body, one of said shoulder being engageable with a mating shoulder in said impeller and the other of shoulders being engageable with a mating shoulder in said hub in said disengaged position of said pawls so that torque transfer between said hub and said impeller is primarily through said pawl body.

15. A drive head as defined in claim 14, each said pawl further having a shoulder for engaging a mating shoulder in the inner surface of said impeller, said pawl shoulder being located at the trailing end of said arcuate surface with respect to the forward direction of rotation of said shaft and extends in a longitudinal plane which intersects the inner surface of the impeller.

* * * * *

UNITED STATES PATENT AND TRADEMARK OFFICE

CERTIFICATE OF CORRECTION

PATENT NO. : 6,135,740
DATED : October 24, 2000
INVENTOR(S) : Hult et al.

It is certified that error appears in the above-identified patent and that said Letters Patent is hereby corrected as shown below:

Column 4,
Line 58, change "form" to -- from --.

Signed and Sealed this

Nineteenth Day of February, 2002

*Attest:*

*Attesting Officer*

JAMES E. ROGAN
*Director of the United States Patent and Trademark Office*